US007108065B2

(12) United States Patent
Bertoja et al.

(10) Patent No.: US 7,108,065 B2
(45) Date of Patent: Sep. 19, 2006

(54) TECHNIQUE FOR PREVENTING DEPOSITION PRODUCTS FROM IMPEDING THE MOTION OF A MOVABLE COMPONENT

(75) Inventors: Michael Bertoja, Pearland, TX (US); Christophe Rayssiguier, Melun (FR)

(73) Assignee: Schlumberger Technology Corporation, SugarLand, TX (US)

( * ) Notice: Subject to any disclaimer, the term of this patent is extended or adjusted under 35 U.S.C. 154(b) by 167 days.

(21) Appl. No.: 10/326,024

(22) Filed: Dec. 19, 2002

(65) Prior Publication Data

US 2004/0118563 A1 Jun. 24, 2004

(51) Int. Cl.
*E21B 31/00* (2006.01)

(52) U.S. Cl. ..... 166/301

(58) Field of Classification Search ..... 166/301, 166/311, 242.2, 242.4, 902, 177.7, 177.6; 175/316; 138/DIG. 6
See application file for complete search history.

(56) References Cited

U.S. PATENT DOCUMENTS 925,906 A * 6/1909 Heeter ..... 277/339
2,241,561 A * 5/1941 Lloyd ..... 166/134
2,336,334 A * 12/1943 Zublin ..... 175/75
2,760,583 A * 8/1956 Kline et al. ..... 166/196
2,876,708 A * 3/1959 Frost ..... 166/106
2,907,351 A * 10/1959 Rohrback et al. ..... 285/55
2,956,626 A * 10/1960 Hall ..... 166/55
3,916,999 A 11/1975 Ellis et al.
4,499,947 A * 2/1985 Zsoka et al. ..... 166/179
5,549,333 A * 8/1996 Uherek et al. ..... 285/45

FOREIGN PATENT DOCUMENTS

GB 861252 9/1961
GB 2156875 A 10/1985
GB 2236129 A 3/1991
GB 2357529 A 10/1999

* cited by examiner

*Primary Examiner*—Kenneth Thompson
(74) *Attorney, Agent, or Firm*—Robert A. VanSomeren; Kevin P. McEnaney; Jaime A. Castano

(57) ABSTRACT

A technique for preventing mineral, mineral salt and other deposits from impeding the motion of movable components in a submerged environment. The technique allows for a movable component in a submerged environment to move freely beneath a deformable member. As the member deforms, it fractures deposition products so they do not significantly impede the path of the movable component.

17 Claims, 5 Drawing Sheets

TECHNIQUE FOR PREVENTING DEPOSITION PRODUCTS FROM IMPEDING THE MOTION OF A MOVABLE COMPONENT

FIELD OF THE INVENTION

This invention relates generally to the use of movable components, either external or internal, which are utilized in completion systems that are disposed in a wellbore during operation.

BACKGROUND OF THE INVENTION

A variety of systems are used to facilitate the production of fluid from subterranean formations, tanks and other structures that compel the use of various completion systems. In a fluid production system, for example, a pump inlet may allow the production fluid entry to the production tubing for delivery of fluid to the surface. Control lines from the surface may be employed to control and regulate the function of the various subterranean components involved in fluid production. Control and regulation of these components may involve the movement of valves, levers, pistons, sleeves, or other moving parts located on the external or internal surfaces of the submerged components.

The aqueous or partially aqueous environment in which components are often submerged may contain various dissolved minerals representative of the subterranean environment. As chemical reactions occur within the environment, with the components, or in response to the temperature and pressure changes which occur in the vicinity of the equipment, minerals and mineral salts precipitate out of solution and form layers of deposits on the submerged components. The rock-hard layers of minerals and mineral salts may, over time, prevent the proper function of parts that move along the exposed surfaces, either internal or external, of the submerged equipment. In particular, as the layers form, moving parts may be prevented from moving in their desired range of motion, impacting the control and regulation of the system as a whole.

The present invention addresses these and other problems found in supporting equipment in a downhole environment.

SUMMARY OF THE INVENTION

The present technique relates generally to preventing mineral and mineral salt deposits from impeding the motion of a movable component in a submerged environment. The technique generally comprises providing a flexible or elastic sleeve under which the movable component moves. Deposition products are only formed on the sleeve and do not impede the movable component as the sleeve temporarily deforms in response to movement by the movable component. In addition, as the sleeve deforms, the layer of deposition products is potentially broken into fragments, some or all of which may fall away from the sleeve.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Although the present technique is described with reference to a specific embodiment utilized in a specific environment, this description should not be construed as limiting. The technique for breaking down mineral deposits and scale can be utilized with a variety of completion systems as well as other systems that may require mechanical motion in an aqueous environment. Similarly, the technique can be used in a variety of environments other than the exemplary subterranean, wellbore environment described. The specific embodiment and environment illustrated and described is used to facilitate an understanding of the invention rather than to limit the invention. On the contrary, the intention is to cover all modifications, equivalents, and alternatives falling within the spirit and scope of the invention as defined by the appended claims.

Figure 1:
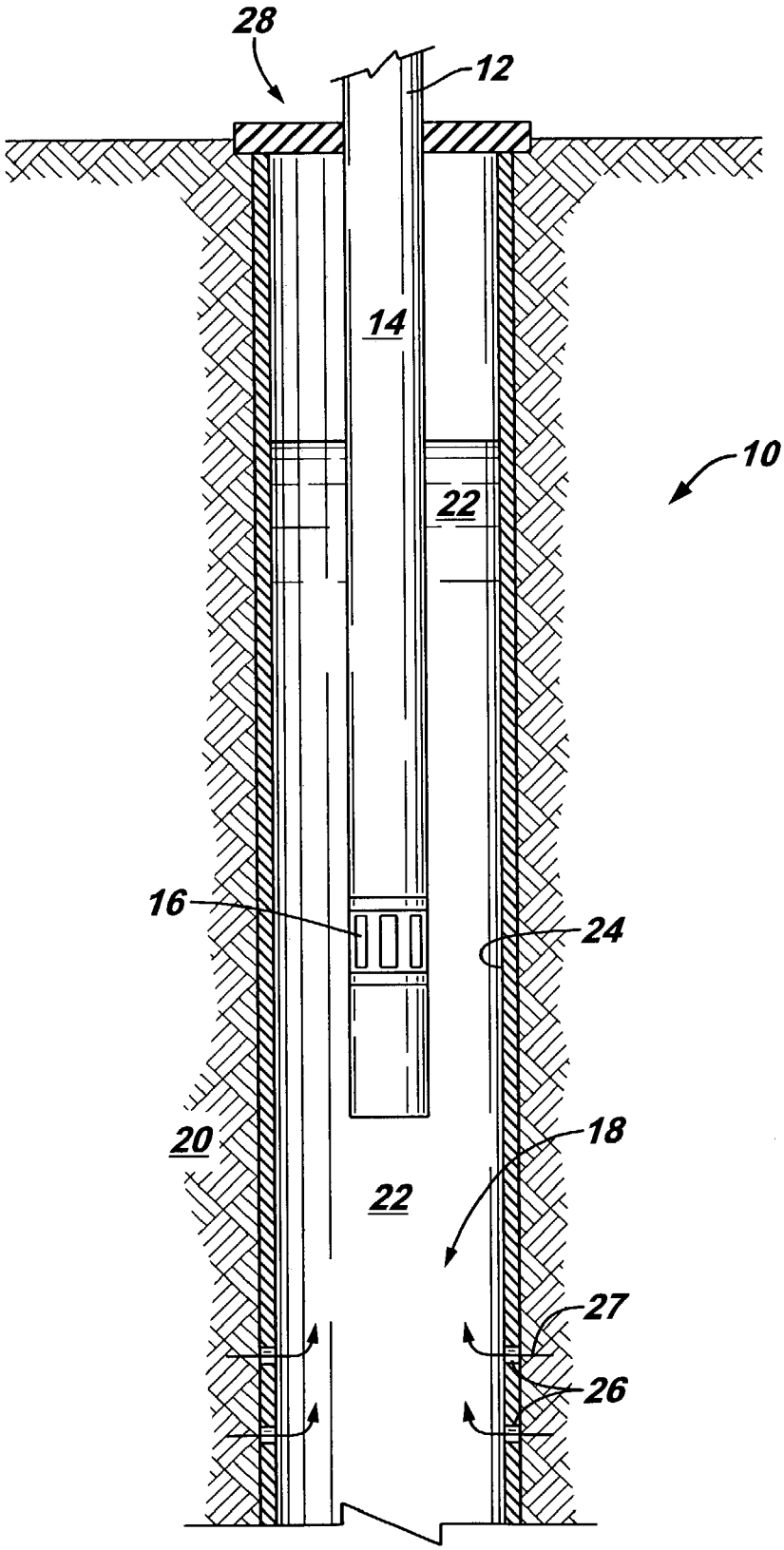
FIG. 1 depicts an exemplary system deployed in a subterranean environment, according to one embodiment of the present invention.
Figure 2:
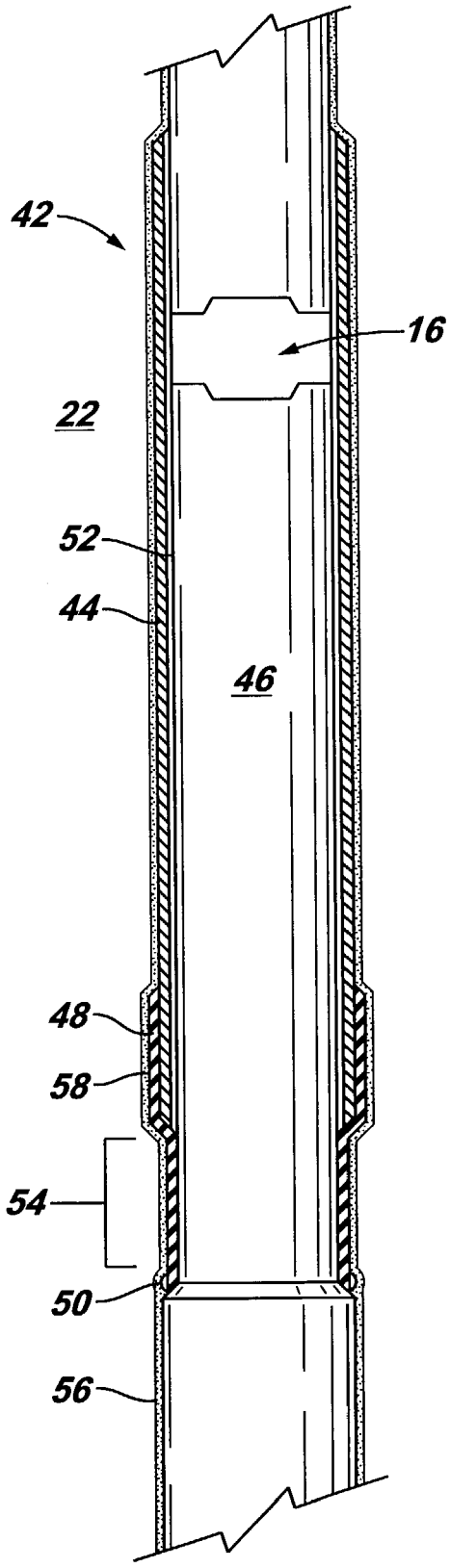
FIG. 2 is a cross-sectional view of one embodiment of the present technique prior to movement by the movable component.

Referring generally to FIG. 1, an exemplary completion system 10 is illustrated. The exemplary system comprises at least tubing 12 and a fluid intake 16.

The production system 10 is designed for deployment in a well 18 within a geological formation 20 containing desirable production fluids, such as petroleum. In a typical application, a wellbore 22 is drilled and lined with a wellbore casing 24. Wellbore casing 24 may comprise a plurality of openings 26, commonly referred to as perforations, through which a production fluid 27 flows into wellbore 22 from the formation 20. The system 10 is deployed in wellbore 22 by a deployment system 28 that may have a variety of configurations. For example, deployment system 28 may comprise tubing 12 which extends into the fluid production region. The production fluid 27 moves into the tubing 30 via the fluid intake 16 where it is then conducted to the desired location, e.g. the surface of the earth. The flow of fluid 27 into the tubing 30 and up to the surface may result from the natural fluid pressure within the formation 20 or may be enhanced by the addition of a submersible pump and pumping system to the fluid production system 10.

Numerous aspects of the completion system 10 may rely on mechanical motion to change from one operating state to another or to regulate the flow of production fluids. Control lines which run from the surface may control the setting of these valves or other mechanical interfaces which regulate the operation of various components within or cooperating with the completion. For example, the control lines may induce the operation of a valve, a lever, a piston, sleeve, or some other moving component which regulates the operation of the completion system 10, such as the intake of production fluid 27.

The wellbore environment, however, is generally hostile to mechanical equipment disposed downhole. In addition to high temperature and pressure as well as corrosive conditions, the wellbore is also typically an aqueous or partially aqueous environment. This aqueous nature of the wellbore, over time, can lead to mineral and mineral salt deposits, sometimes called scale, which coat the metallic and other surfaces of the downhole equipment. The deposition of minerals may be due to a chemical reaction with the surface of the equipment, chemical reactions within the water and other fluids within the wellbore, changes in pressure or temperature, or a change in the composition of the solution surrounding the equipment. Scale may also be formed as a byproduct of corrosion. The deposition products which comprise scale typically include calcium carbonate, calcium sulfate, barium sulfate, strontium sulfate, iron sulfide, iron oxides, iron carbonate, the various silicates, phosphates, and oxides, or any of a number of compounds insoluble or only slightly soluble in water.

In the production environment, the deposition of scale may occur over time on wellbore tubulars and components. Scale deposition on the production components occurs as the relative amount of water in the surrounding porous rock is affected by the changing temperature and pressure conditions near the production components. In particular, as temperature and pressure change, minerals and mineral salts may be forced out of solution, coating the surfaces of the components comprising the submersible completion 10. Significant scale buildup may thereby create a significant restriction to the movement of parts that regulate or control the operation of the submersible equipment. For example, scale may prevent a valve, such as a flow control valve, from properly opening or closing. Likewise levers and pistons arrangements, i.e. sliding parts, may be prevented from sliding from one operational state to another if the surface over which they move is coated with scale deposits.

One technique by which the problems caused by scale deposition may be addressed is shown in FIGS. 2–6, in which a flow regulator 42, consisting of a sleeve which slides over the fluid inlet 16, is depicted in cross section. It is to be understood that the flow regulator 42 is merely representative of the type of moving parts which may be found on the internal and external surfaces of downhole submersible components.

The hydraulic regulator 42 comprises a moving component, here represented as sliding sleeve 44, which moves along the surface of a stationary component 46, such as the tubing 12 or some other component of the completion 10. An elastic or flexible covering, such as a rubber sleeve 48, is secured to the stationary component 46 by a clamp 50. Other means may be used to secure the elastic sleeve 48 to the stationary part 46, however, such as screws or other mechanical fasteners or chemical fasteners such as adhesives.

Figure 3:
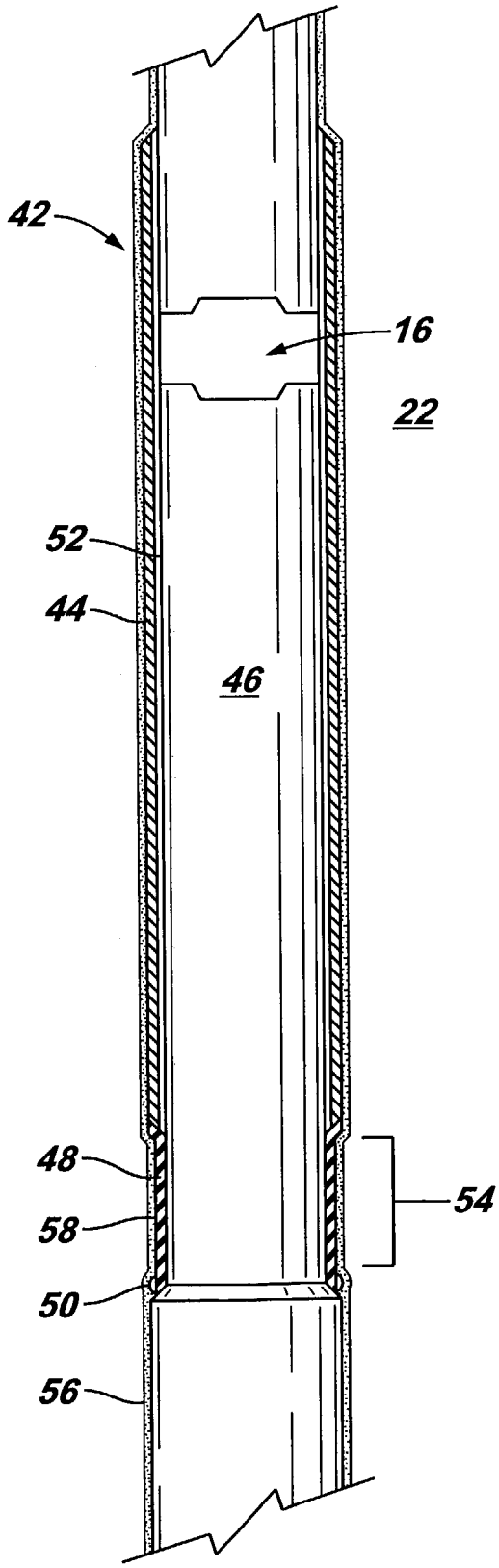
FIG. 3 is an enlarged view of the embodiment as depicted in FIG. 2.

The elastic sleeve 48 covers a portion of the surface 52 of the stationary component 46 including an engagement region 54 along which the moving component 44 moves. In the embodiment depicted in FIG. 2, the elastic sleeve 48 also covers at least a portion of the moving component 44. Alternately, as illustrated in FIG. 3, the elastic sleeve 48 may be disposed immediately adjacent to the moving component 44. In the embodiment depicted in FIG. 3, when the moving component 44 translates across the engagement region 54, it moves underneath the portion of the elastic sleeve 48 disposed over the engagement region 54.

Figure 4:
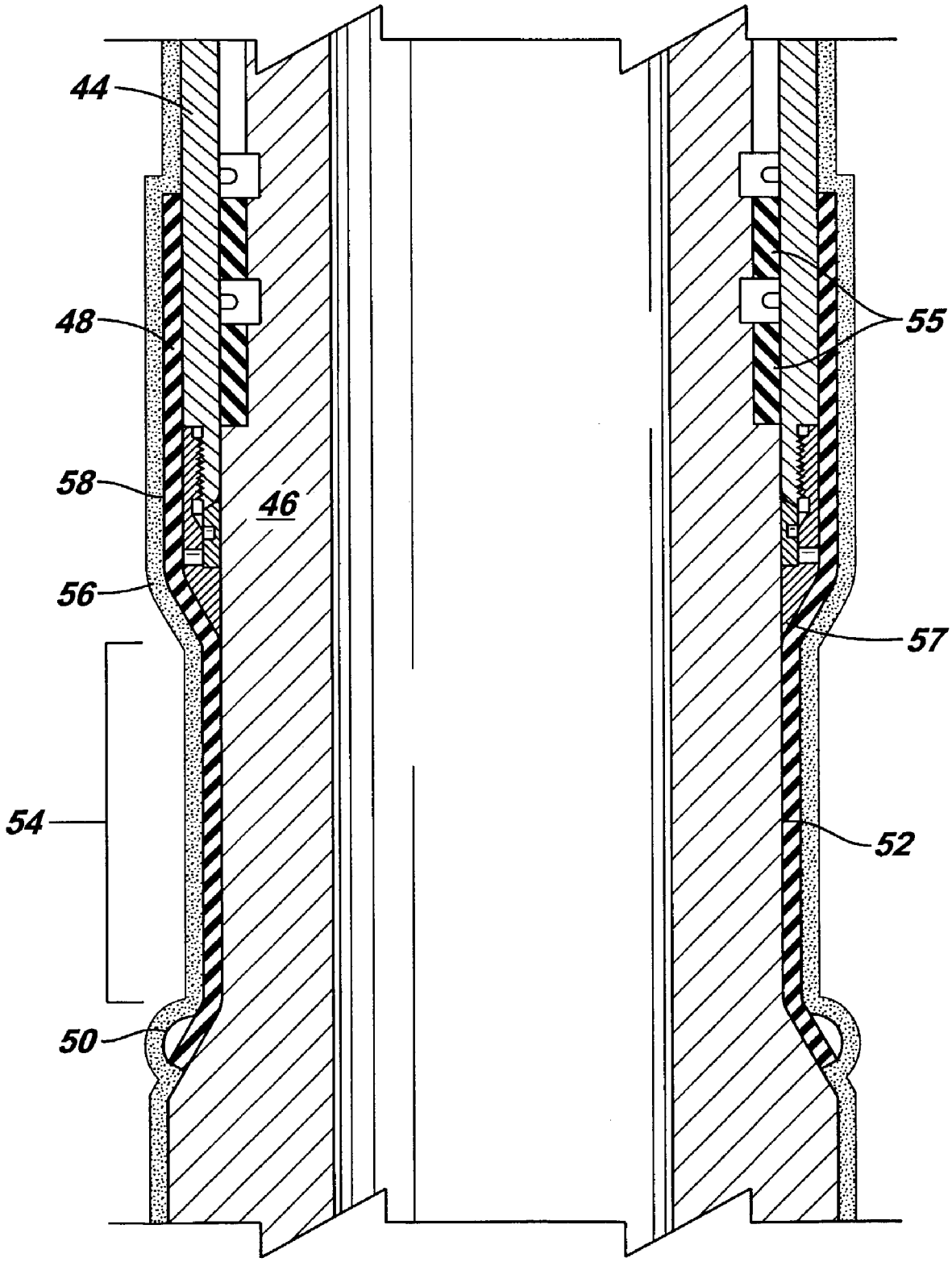
FIG. 4 is a cross-sectional view of an alternative embodiment of the present technique prior to movement by the movable component.

The engagement region 54 and adjacent regions of one embodiment are enlarged and depicted in FIG. 4 to provide further detail. In particular, FIG. 4 depicts the various seals 55 which may underlay the moving component 44 in an arrangement supporting the depicted sliding sleeve. In addition, the moving component 44 may be seen to comprise an angled leading edge 57 to facilitate movement under the elastic sleeve 48.

Figure 5:
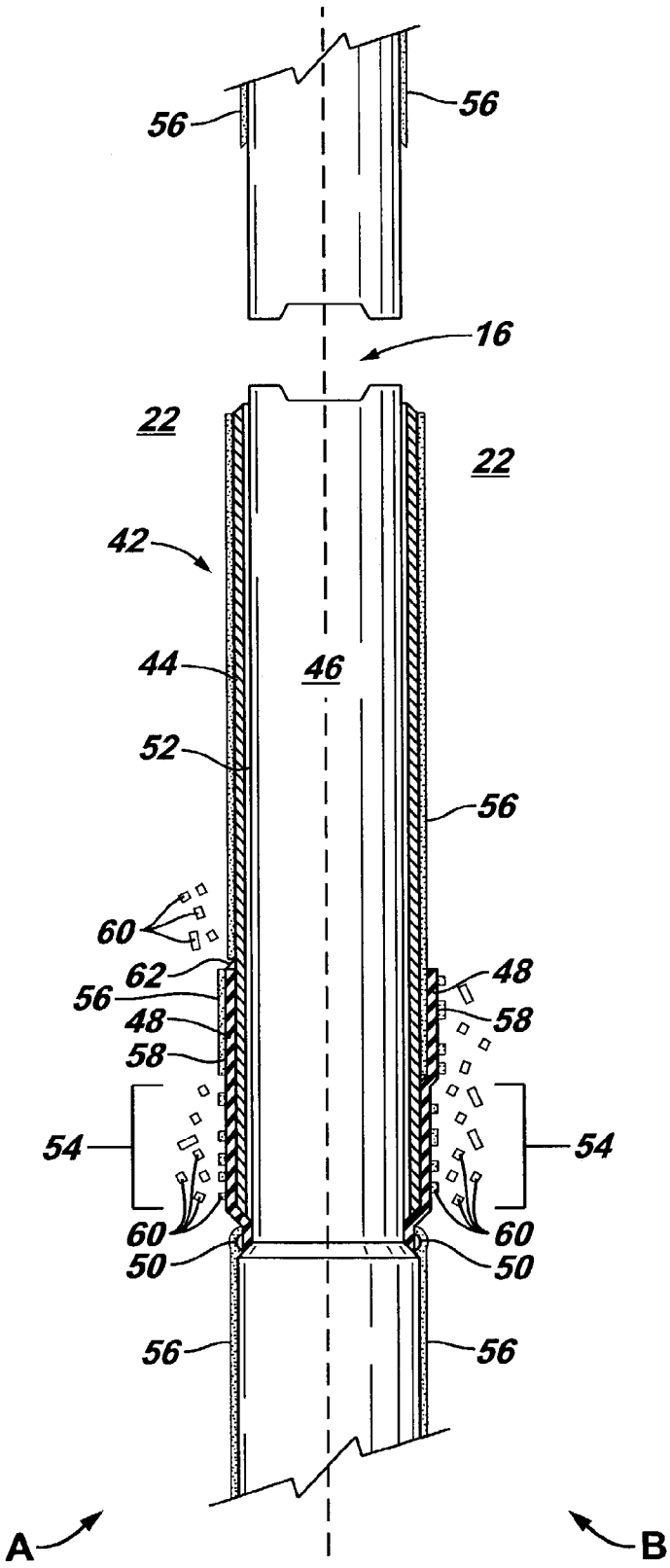
FIG. 5 is a cross-sectional view of the present technique subsequent to movement by the movable component.
Figure 6:
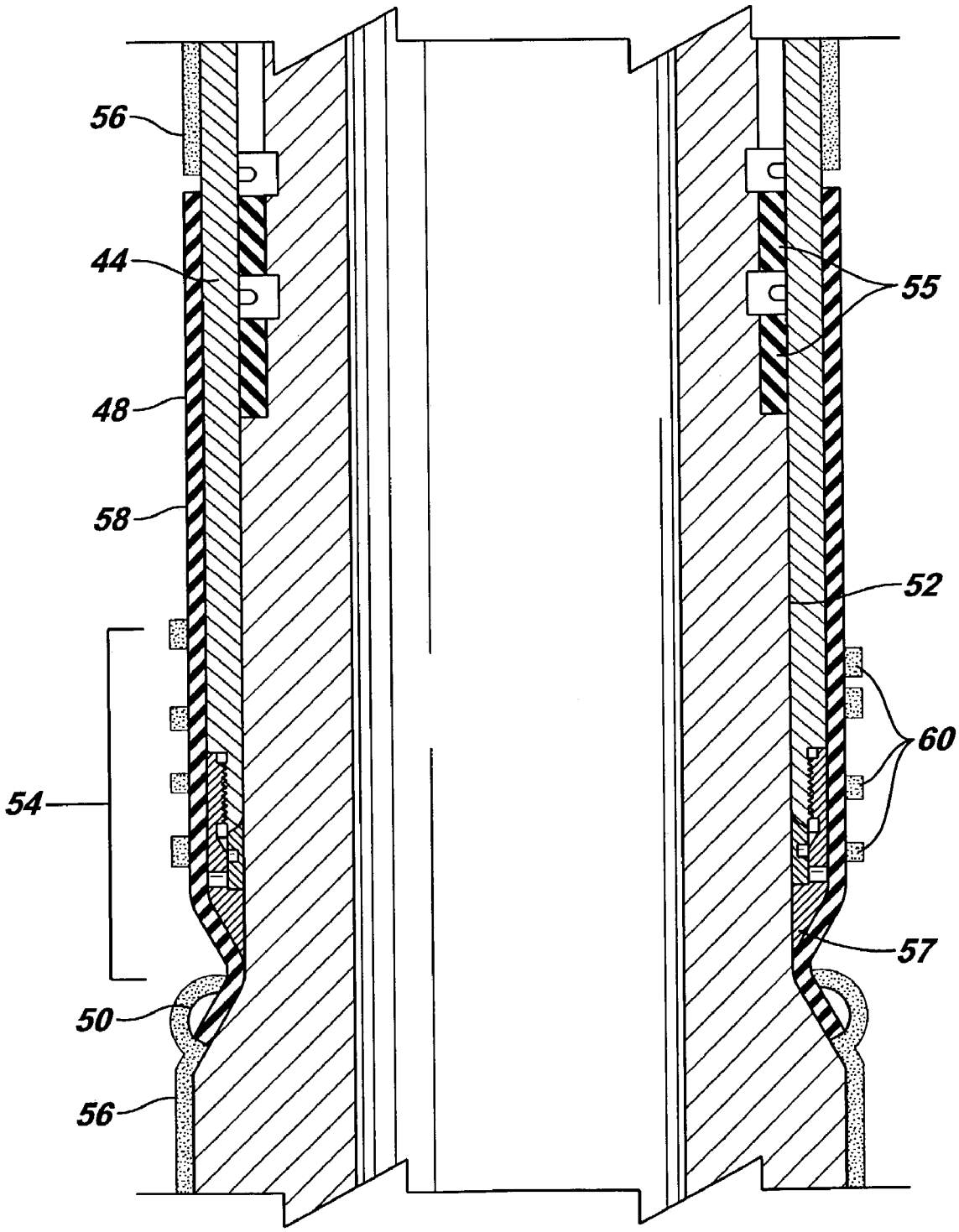
FIG. 6 is an enlarged view of the embodiment as depicted in FIG. 5.

An exemplary layer of scale 56 is illustrated on the exterior surface 58 of the elastic sleeve 48 which is exposed to the environment within the wellbore 22. As depicted in FIG. 5 and in FIG. 6 which depicts the engagement region 54 in enlarged scale, when the moving component 44 traverses along the engagement region 54 of the stationary component 46, it need not break through the layer of scale 56. Instead, when the moving component 44 moves along the engagement region 54, it pushes the elastic sleeve 48 up and away from the surface 52 of the region 54. As the sleeve 48 temporarily deforms, it lifts the scale 56 out of the path of the moving component 44, fracturing the scale 56 over the deformed region into fragments 60 (see FIGS. 5 and 6). These scale fragments 60 may remain attached to the elastic sleeve 48 or may fall off into the wellbore 22. The fragments 60 do not impede the motion of the moving component 44 their removal, however, allows unimpeded functioning of a relevant component, e.g. allowing the fluid intake 16 to be opened.

A scraper edge 62 may be incorporated onto the edge of the elastic sleeve 48 as depicted on side A of FIG. 5. In such a configuration, scale 56 built up along the exposed portion of the moving component 44 is scraped off into the wellbore 22 as the exposed portion of the moving component 44 passes the scraper edge 62. Alternately, as depicted on side B, the elastic sleeve 48 may simply deform to accommodate the scale 56 built up on the exposed portion of the moving component 44 during operation. In this configuration, the additional deformation caused by the scale 56 on the moving component 44 may cause the remainder of the scale 56 on the elastic sleeve 48 to be fracture and removed. However, regardless of which of these, or other, configurations are employed, the portion of the moving component 44 traversing the engagement region 54 is unimpeded due to the lifting action of the elastic sleeve 48, allowing the free motion of the moving component 44.

While the moving component 44 in FIGS. 2–6 is depicted as engaging in a sliding motion, this is only to simplify the explanation of the general technique discussed. The moving component 44 may actually be engaged in rotational motion around the stationary component 46, a combination of sliding and rotational motion, or in other forms of motion along the engagement region 54. In addition, though in the example depicted in FIGS. 2–6 the elastic sleeve 48 is not secured to the moving component 44, in an alternative configuration the elastic sleeve 48 may be so secured. In such a configuration, the elastic sleeve 48 folds or is deformed outwardly when moving component 44 operates, breaking apart the layer of scale 56 on the elastic sleeve 48.

It will be understood that the foregoing description is of exemplary embodiments of this invention, and that the invention is not limited to the specific forms shown. For example, the composition of the elastic sleeve, the mechanism of securing the sleeve, and the types of motion available to the moving component may all vary from the particulars discussed above. Indeed, such changes may be necessary due to the variety of applications which employ submersible equipment submerged within various environmental fluids. However, these and other modifications may be made in the design and arrangement of the elements without departing from the scope of the invention as expressed in the appended claims.

What is claimed is:

1. A method for preventing deposition products from impeding the motion of a movable component deployed in a subterranean environment, comprising:

placing a sleeve and a sleeve component in a subterranean environment such that the sleeve component slides within the sleeve;

covering at least a portion of the sleeve and the sleeve component with an elastic sleeve; and moving the sleeve linearly relative to the sleeve component and beneath the elastic sleeve such that the elastic sleeve is deformed outwardly by contact with the sleeve to fracture a deposition layer formed on the elastic sleeve.

2. The method as recited in claim 1, wherein moving the sleeve relative to the sleeve component comprises operating at least one of a valve, a lever, and a piston which changes position when operated.

3. The method as recited in claim 1, wherein moving the sleeve relative to the sleeve component beneath the elastic sleeve comprises moving the sleeve relative to the sleeve component beneath a rubber sleeve.

4. The method as recited in claim 1, wherein moving the sleeve relative to the sleeve component further comprises rotating the sleeve relative to the sleeve component.

5. A method for forming an apparatus which allows motion without obstruction by deposition products, comprising:

securing a resilient sleeve to a surface of a first sleeve component such that the resilient sleeve lies along a surface of the first sleeve component;

positioning a second sleeve component adjacent to the first sleeve component such that a portion of the second sleeve component can move along the surface of the first sleeve component; and positioning the resilient sleeve over at least an expanse of the surface of the first sleeve component along which the portion of the second sleeve component can move within the resilient sleeve and radially between the resilient sleeve and the first sleeve component such that the resilient sleeve is deformed outwardly by contact with the second sleeve component to fracture a deposition layer formed on the resilient sleeve when the second sleeve component moves.

6. The method as recited in claim 5, wherein the surface of the first sleeve component is an external surface.

7. The method as recited in claim 5, further comprising positioning the resilient sleeve radially outward of the portion of the second sleeve component.

8. The method as recited in claim 5, wherein securing the resilient sleeve to the surface of the first sleeve component comprises clamping the resilient sleeve to the surface of the first sleeve component.

9. The method as recited in claim 5, wherein securing the resilient sleeve to the surface of the first sleeve component comprises fastening the resilient sleeve to the surface of the first sleeve component using one or more mechanical fasteners.

10. The method as recited in claim 5, wherein securing the resilient sleeve to the surface of the first sleeve component comprises adhering the resilient sleeve to the surface of the first sleeve component using an adhesive.

11. A well-completion system, comprising:

a completion deployed in a wellbore by a tubing, the completion having a first sleeve that moves linearly along a second sleeve; and at least one elastic sleeve positioned upon a surface of the completion such that the elastic sleeve covers a mating surface along which the first sleeve moves relative to the second sleeve such that the movement of the first sleeve is along a region located radially between the elastic sleeve and the second sleeve, wherein physical contact between the first sleeve and the elastic sleeve during movement of the first sleeve along the region lifts the elastic sleeve away from the second sleeve and deforms the elastic sleeve radially outward over the first sleeve to fracture a deposition layer formed on the elastic sleeve.

12. The system as recited in claim 11, wherein the surface of the completion is an external surface.

13. The system as recited in claim 11, wherein the at least one elastic sleeve is made of rubber.

14. A device for use in at least one of an aqueous and partially aqueous environment, comprising:

a sleeve component having a surface along which a sleeve moves; and an elastic sleeve positioned on the surface such that the motion of the sleeve occurs in a region radially between the elastic sleeve and the sleeve component to deform the elastic sleeve, wherein the sleeve moves along the surface in a rotational motion.

15. The device as recited in claim 14, further comprising a control interface through which the sleeve's motion is controlled.

16. The device as recited in claim 14, wherein the elastic sleeve is rubber.

17. The device as recited in claim 14, wherein the sleeve also moves along the surface in a linear sliding motion.

* * * * *